US005601451A

United States Patent [19]

Driones et al.

[11] Patent Number: 5,601,451

[45] **Date of Patent: *Feb. 11, 1997**

[54] COMBINATION CONNECTOR

[75] Inventors: Francisco R. Driones, Markham; Kamal S. Boutros, Richmond Hill, both of Canada

[73] Assignee: Amphenol Corporation, Wallingford, Conn.

[ * ] Notice: The portion of the term of this patent subsequent to Mar. 28, 2014, has been disclaimed.

[21] Appl. No.: 422,865

[22] Filed: Apr. 17, 1995

Related U.S. Application Data

[63] Continuation-in-part of Ser. No. 252,425, Jun. 1, 1994, Pat. No. 5,407,366, which is a continuation-in-part of Ser. No. 219,161, Mar. 28, 1994, Pat. No. 5,401,192.

[51] Int. Cl.[6] ..... H01R 13/658; H01R 13/66

[52] U.S. Cl. ..... 439/490; 439/639

[58] Field of Search ..... 439/490, 488, 439/638, 639, 540.1, 607, 701, 535, 95, 101, 675, 581

[56] References Cited

U.S. PATENT DOCUMENTS

| | | | |
|---|---|---|---|
| 1,720,463 | 7/1929 | Both . | |
| 2,474,407 | 6/1949 | Todd et al. | 177/311 |
| 2,503,677 | 4/1950 | McHenry et al. | 177/311 |
| 3,265,888 | 8/1966 | Adolphson, Jr. | 240/73 |
| 3,500,293 | 3/1970 | Cocco | 339/113 |
| 3,753,261 | 8/1973 | Thaxton | 340/252 P |
| 3,879,103 | 4/1975 | Peltola et al. | 339/177 R |
| 3,932,020 | 1/1976 | Gilbert, Jr. | 439/675 |
| 3,980,382 | 9/1976 | Reeder | 339/177 R |
| 4,379,606 | 4/1983 | Clark et al. | 339/17 CF |
| 4,386,818 | 6/1983 | Millhimes et al. | 339/113 L |
| 4,397,513 | 8/1983 | Clark et al. | 339/91 R |
| 4,412,717 | 11/1983 | Monroe | 339/177 R |
| 4,500,159 | 2/1985 | Briones et al. | 339/147 R |
| 4,618,207 | 10/1986 | Silbernagel | 339/176 |
| 4,629,266 | 12/1986 | Viselli | 339/17 |
| 4,666,231 | 5/1987 | Sheesley et al. | 439/581 |
| 4,690,479 | 9/1987 | Hollyday et al. | 439/97 |
| 4,695,105 | 9/1987 | Ney et al. | 439/95 |
| 4,695,115 | 9/1987 | Talend | 439/76 |
| 4,712,849 | 12/1987 | Seidel et al. | 439/607 |
| 4,726,638 | 2/1988 | Farrar et al. | 439/620 R |
| 4,727,648 | 3/1988 | Savaga, Jr. | 29/839 |
| 4,772,224 | 9/1988 | Talend | 439/607 |
| 4,795,352 | 1/1989 | Capp et al. | 439/63 |
| 4,799,901 | 1/1989 | Pirc | 439/620 |
| 4,804,332 | 2/1989 | Pirc | 439/620 |
| 4,842,529 | 6/1989 | Frantz et al. | 439/95 |
| 4,843,326 | 6/1989 | Smythe | 324/503 |
| 4,850,902 | 7/1989 | Reed | 439/676 |
| 4,884,982 | 12/1989 | Fleming et al. | 439/620 |
| 4,923,310 | 5/1990 | Sekiguchi et al. | 439/701 |
| 4,978,317 | 12/1990 | Pocrass | 439/490 |
| 5,057,041 | 10/1991 | Yu et al. | 439/620 |
| 5,062,811 | 11/1991 | Hackman | 439/620 |
| 5,073,123 | 12/1991 | Birch et al. | 439/188 |
| 5,083,945 | 1/1992 | Miskin et al. | 439/607 |

(List continued on next page.)

FOREIGN PATENT DOCUMENTS

| | | | |
|---|---|---|---|
| 40000934 | 8/1990 | Germany | 439/639 |
| 53-86387 | 7/1978 | Japan . | |
| 2169156 | 7/1986 | United Kingdom . | |

OTHER PUBLICATIONS

National Tel–Tronics product brochure "The New Wave in Coaxial Connectors".

*Primary Examiner*—Gary F. Paumen
*Attorney, Agent, or Firm*—Bacon & Thomas

[57] ABSTRACT

In order to save space and reduce the number of parts needed to mount a plurality of connector types on a circuit board, the different connector types share a common molded housing. In addition, at least one indicator light is included in the molded housing, and is arranged adjacent the lower surface of the housing in a way which minimizes the indicator light contact lengths and facilitates insertion and removal of the indicator light.

12 Claims, 5 Drawing Sheets

U.S. PATENT DOCUMENTS

| | | | |
|---|---|---|---|
| 5,102,354 | 4/1992 | Crane et al. | 439/620 |
| 5,108,300 | 4/1992 | Weber | 439/188 |
| 5,125,854 | 6/1992 | Bassler et al. | 439/607 |
| 5,143,868 | 9/1992 | Caveney et al. | 439/638 |
| 5,145,412 | 9/1992 | Tan et al. | 439/620 |
| 5,158,480 | 10/1982 | Blondeel et al. | 439/607 |
| 5,167,536 | 12/1992 | Wang | 439/620 |
| 5,169,329 | 12/1992 | Taguchi | 439/188 |
| 5,192,228 | 3/1993 | Collins et al. | 439/607 |
| 5,207,597 | 5/1993 | Kline | 439/607 |
| 5,288,246 | 2/1994 | Whiteman, Jr. et al. | 439/540 |
| 5,290,175 | 3/1994 | Robinson et al. | 439/540 |
| 5,326,280 | 7/1994 | Briones et al. | 439/581 |

103
104
105
106
107
108
109
110
111
112
113
114
115
116
117
118
119
120
121
122
123
125
126
130
131
132
133
136
137
138
140
141

COMBINATION CONNECTOR

This application is a continuation-in-part of application Ser. No. 08/252,425, filed Jun. 1, 1994, now U.S. Pat. No. 5,407,366, issued Apr. 18, 1995, which in turn is a continuation-in-part of application Ser. No. 08/219,161, filed Mar. 28, 1994, now U.S. Pat. No. 5,401,192, issued Mar. 28, 1995.

BACKGROUND OF THE INVENTION

1. Field of the Invention

The invention relates to electrical connectors, and in particular to electrical connectors of the type used to couple data communications cables with circuitry on a network or communications interface card.

2. Description of Related Art

An RJ-45 connector in which an indicator light is included within the connector housing is known from U.S. Pat. No. 4,978,317. One of the embodiments of the invention disclosed herein involves a similar use of an indicator light, namely in a combination connector of the type first described in U.S. Pat. No. 5,401,192, from which priority of the present application under 35 USC §120 is claimed. The indicator light embodiment is one of several embodiments disclosed in this application, all of which have to do with combination connectors designed for use on computer interface cards, and is the only one not disclosed in the related priority applications.

The demand for cables and connectors capable of transferring data between computers and peripherals has increased exponentially in recent years as the advantages of networked systems of personal computers, and access to the so-called information highway, have become increasingly evident to users. Despite the increasing popularity of modem communications and networked computer systems, however, and the corresponding tendency towards standardization of system components, there currently exists a wide variety of different cable and connector types, with none likely to attain exclusivity in the foreseeable future. The different cable types currently in widespread use include twisted pair cables and coaxial cables for serial communications, and numerous different multiple wire configurations for parallel communications.

In general, twisted pair cables are coupled to a network or data communications interface via connectors of the type popularly referred to as modular phone jack connectors because of their resemblance to the standard four wire telephone jack connector. This type of connector is commonly denoted by the letters RJ, followed by a numerical indicator (e.g., the RJ 45 connector often used in Ethernet applications). An example of a state-of-the-art modular jack connector with advanced filtering capabilities is found in U.S. Pat. No. 5,397,250 issued Mar. 14, 1995.

Coaxial cable connections are usually accomplished by a type of connector known as the BNC connector. An example of a state-of-the-art BNC connector with advanced filtering capabilities is shown in U.S. Pat. No. 5,326,280 issued Jul. 5, 1994.

Multiple wire cables, on the other hand, utilize a variety of different multiple pin connectors, including mini-DIN connectors and D-sub connectors such as the RS-232 standard 25 pin (DB25) connector, or the 15 pin (DB15) connector commonly used in Ethernet cards. Depending on the specific needs of the user, these connectors may be either shielded or unshielded, and may or may not include filter components such as capacitors.

Although each different cable type requires a different connector, the use of separate interface cards for each type of cable or connector is unnecessarily redundant, and thus it is common to provide more than one type of connector on a single card in order to enable the card to communicate with compatible devices which differ only in the choice of cable or connector required. The Ethernet network interface, for example, can interchangeably use all three of the above-mentioned types of cable and thus, in order to provide compatibility with a maximum number of external devices, it is common to provide as many as three different types of connectors on a single Ethernet interface or adapter card.

Fortunately for interface card manufacturers, the three most common types of connectors—modular jack connectors, BNC connectors, and D-sub parallel connectors—are small enough to fit side-by-side on a standard network card. Conventionally, this is accomplished without modifying the connectors. However, it turns out, for reasons which were not previously appreciated by those skilled in the art, that placement of the three standard connectors on a card without modification is a less than optimal configuration.

The first reason why it is disadvantageous to place multiple connectors on a single card without modification of the connectors has to do with the cost of the circuit board on which the connectors are placed. This cost, previously ignored by connector designers, is significant. Even though the space occupied by multiple connectors placed side-by-side on an interface card may be acceptable from the standpoint of compatibility with available slots in the device within which the card is to be used, this space necessitates a larger board than might otherwise be required. Even small decreases in the total footprint of the connectors can result in significant savings in materials costs. For example, printed circuit board materials presently cost approximately $0.12 per square inch. This is a very high cost when one considers the volume of cards sold and the overall price of each card, and thus it would be very desirable to reduce the size of the card as much as possible. A reduction in width of one half inch for a typical eight inch interface card saves, at approximately $.048 in material costs per card.

The second reason why placement of multiple connectors on a card without modification is less than optimal is that the provision of multiple connectors on a card results in redundancies, previously unrecognized, which could be eliminated by sharing certain components between connectors, in particular housings, shielding, and the board locks used to mount the connectors on the card.

The connectors described in the above-mentioned U.S. Pat. No. 5,401,192 and U.S. Pat. No. 5,407,366 issued Apr. 18, 1995 solve the problems of reducing card height and sharing components by providing components for combinations of the modular jack, BNC, and D-Sub connectors in a single molded housing, and by providing a common shield for the respective connectors. Despite this optimal use of connector components, however, a demand exists for one additional improvement described herein, namely the inclusion of indicator lights. Conventionally, indicator fights are provided separately from any connectors on the circuit card, but in situations where a combination connector is desirable, the inclusion of indicator lights in the connector itself would also be desirable as a space saving measure. The indicator light described in this continuation-in-part application is designed to be used for test purposes, providing an easy visual reference for enabling the tester of a circuit card to test the operation of circuits on the card, although those skilled in the appreciate that the indicator light described herein can also be used as a status indicator during normal operation of the card.

SUMMARY OF THE INVENTION

It is accordingly a first objective of the invention to provide a connector configuration for a circuit board or card which requires less space than conventional configurations, and which may further include an indicator light.

It is a second objective of the invention to provide a connector configuration for a circuit card in which redundancy is eliminated by sharing components between the connectors.

It is a third objective of the invention to provide a combined modular jack and BNC connector having an indicator light for use on a circuit card.

It is a fourth objective of the invention to provide a single connector configuration for a circuit card capable of providing modular phone jack, BNC and/or D-sub connections, both shielded and unshielded, with or without filtering.

It is a fifth objective of the invention to provide a BNC connector in which all dielectric parts, including an indicator light housing, are provided by a single mold.

It is a sixth objective of the invention to provide a combination connector configuration for a circuit card which includes an indicator light for testing the operation of circuitry on the card.

These objectives are accomplished, in various preferred embodiments of the invention by providing a combined modular phone jack, BNC, and/or multiple pin connector having a single molded housing and a common shield for the BNC and modular phone jack portions of the combined connector.

The objectives are further accomplished in one embodiment of the invention by providing a combination connector in which a single molded housing is provided for more than one type of connector, and in which the single molded housing is also shared by an indicator light.

In all of the embodiments of the invention, including those with and without an indicator light, additional reductions in the number of parts are achieved by, respectively, forming a board lock integrally with the common shield, and forming both the inner and outer insulators of the BNC section of the connector, which are conventionally formed separately, as integral parts of the single molded housing structure. These designs not only have the advantage of using less space and less parts, but also has the advantage of requiring fewer and simpler assembly steps than are required for separate assembly of the three individual types of connectors as currently configured.

DETAILED DESCRIPTION OF THE PREFERRED EMBODIMENTS

Figure 1:
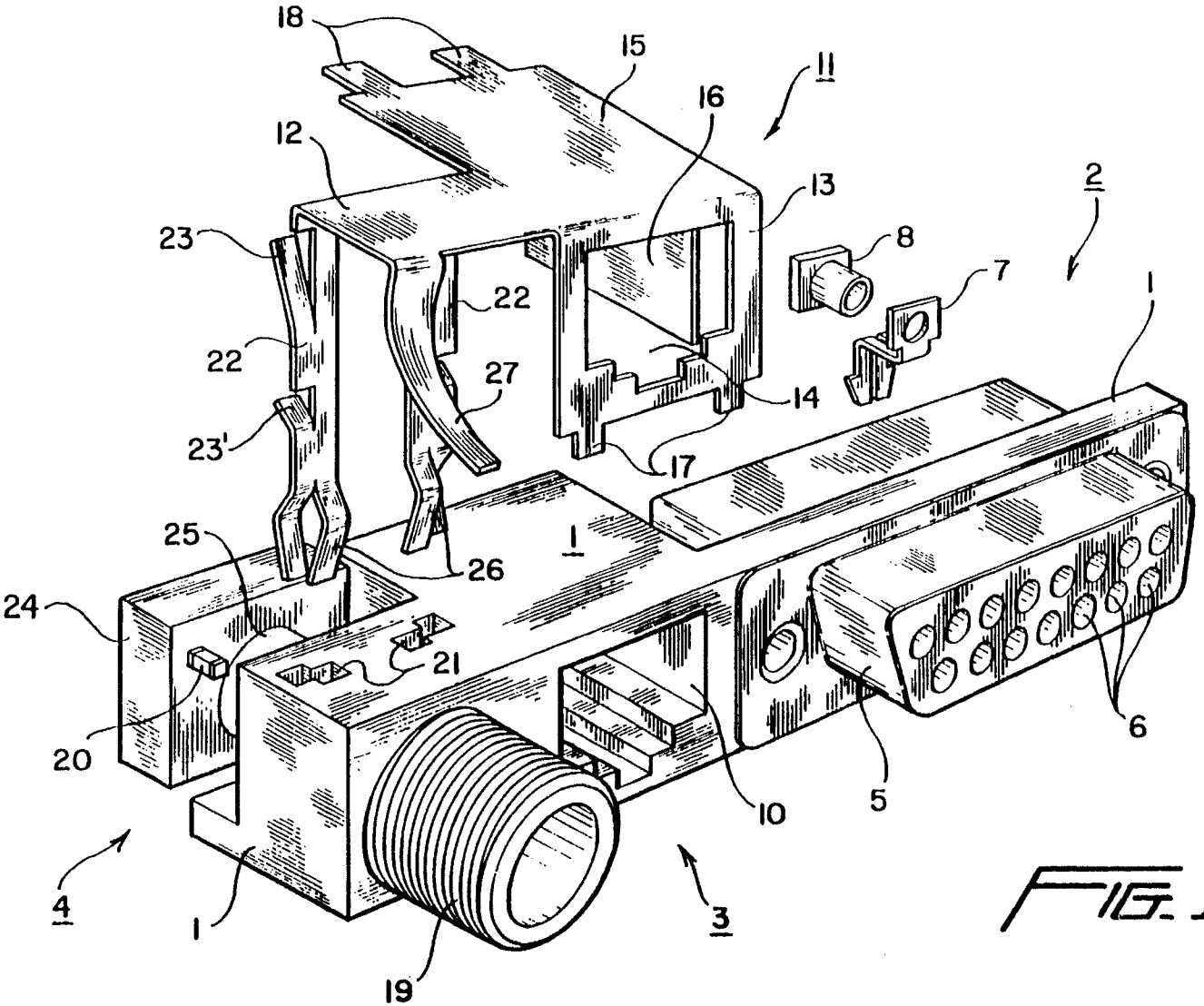
FIG. 1 is a perspective view of a connector constructed in accordance with the principles of a first preferred embodiment of the invention.

As shown in FIG. 1, the connector of the first preferred embodiment includes a combined housing 1 having a D-sub section 2, a modular jack section 3, and a BNC section 4. The shared housing 1 is preferably molded from a suitable plastic, in which case the housing can easily be made in a variety of configurations for different connector types, the illustrated types being typical of a network interface card.

The D-sub section 2 of the first preferred embodiment is conventional in nature, except that its housing is integral with the housing of the modular jack section. Included in this section are a conventional metal shield 5 which surrounds a D-shaped front portion including apertures 6 for receiving correspondingly shaped male or female connector contacts (not shown). Unlike the standard D-sub connector, however, the illustrated D-sub connector section 2 requires only a single board lock 7 for securing the D-sub section on the board. An optional connecting pin 9 for electrically connecting shield 5 with the board lock to provide a ground path therethrough when the board lock is secured to the circuit board may also be provided. Those skilled in the art will recognize that the configuration of the rear portion of the connector section, which is arranged to permit connections between the contacts and the board, is conventional and may be varied according to the specific requirements of the type of D-sub being implemented.

The modular jack section 3 of the connector has a shape identical to the shape of the standard modular jack connector, except that the housing is integrally molded with connector section 2 and 4. The jack receiving aperture 10 in the front of the section, and all internal components (not shown) are identical to those found in conventional jack connectors. The principal departure from conventional connectors in this section of the combination connector is that, instead of a conventional stamped and formed shield case which fits over at least four sides of the housing, a modified shield 11, which is also preferably stamped and formed, is provided which is shaped to take into account the fact that only three walls of the section are exposed, and which includes an extension 12 for providing, as will be explained below, grounding in the BNC section 4 of the combination connector.

The portion of shield 11 which covers exposed walls of the modular jack section 3 includes a planar front portion 13 having a cutout 14 corresponding to the aperture 10 in the modular jack, a top portion 15 extending transversely to the front portion 13 which completely covers the top of modular jack section 3, and a single side portion 16 extending transversely to both the top and front portions of section 3, portion 16 being designed to fit between the D-sub connector section 2 and the modular jack section 3. Also included in the illustrated embodiment are pairs of tabs 17 and 18 which can be bent respectively over the bottom and back of the modular jack section to secure the shield on the housing, although those skilled in the art will appreciate that numerous other arrangements for securing the shield on the housing may also be utilized.

Shield 11 includes a lateral extension 12, as noted above, which covers the top of the main body of BNC connector section 4 for use as a ground connection in case the BNC connector is filtered. The filtering arrangement and other aspects of the BNC section, including the shape of a threaded front mating portion 19, are similar to those disclosed in U.S. patent application Ser. No. 08/075,876, and includes filter components, e.g., chip capacitors 20 inserted into slots (not shown) which extend parallel to the direction of the BNC contact and which communicate with vertical passages 21 formed in the connector housing. Lateral extension 12 of shield 11 includes further extensions 22 which fit into passages 21 and which include upper tines 23 and lower tines 23' arranged to extend into corresponding ones of the chip capacitor slots when extensions 13 are inserted into passages 21, thereby biasing any chip capacitors present in the slots against a parallelepiped shaped rear portion 24 of a metal BNC contact 25 of the type disclosed in the above-mentioned application Ser. No. 08/075,876.

The shield 11 also advantageously includes an integral board lock in the form of bifurcated portions 26 at the distal ends of extensions 22. Bifurcation of the ends of extensions results in the formation of fingers which can bend inwardly upon passage through a hole in a circuit board and then outwardly when the hole is cleared to lock the connector on the board in the manner of conventional board locks, but without the need for an extra piece or assembly step. Also included in the shield is a panel-engaging extension 27 similar to those described in copending patent application Ser. No. 08/075,876 for providing a ground path from the shield 11 to a panel on the circuit card or device to which the connector is mounted.

Figure 2:
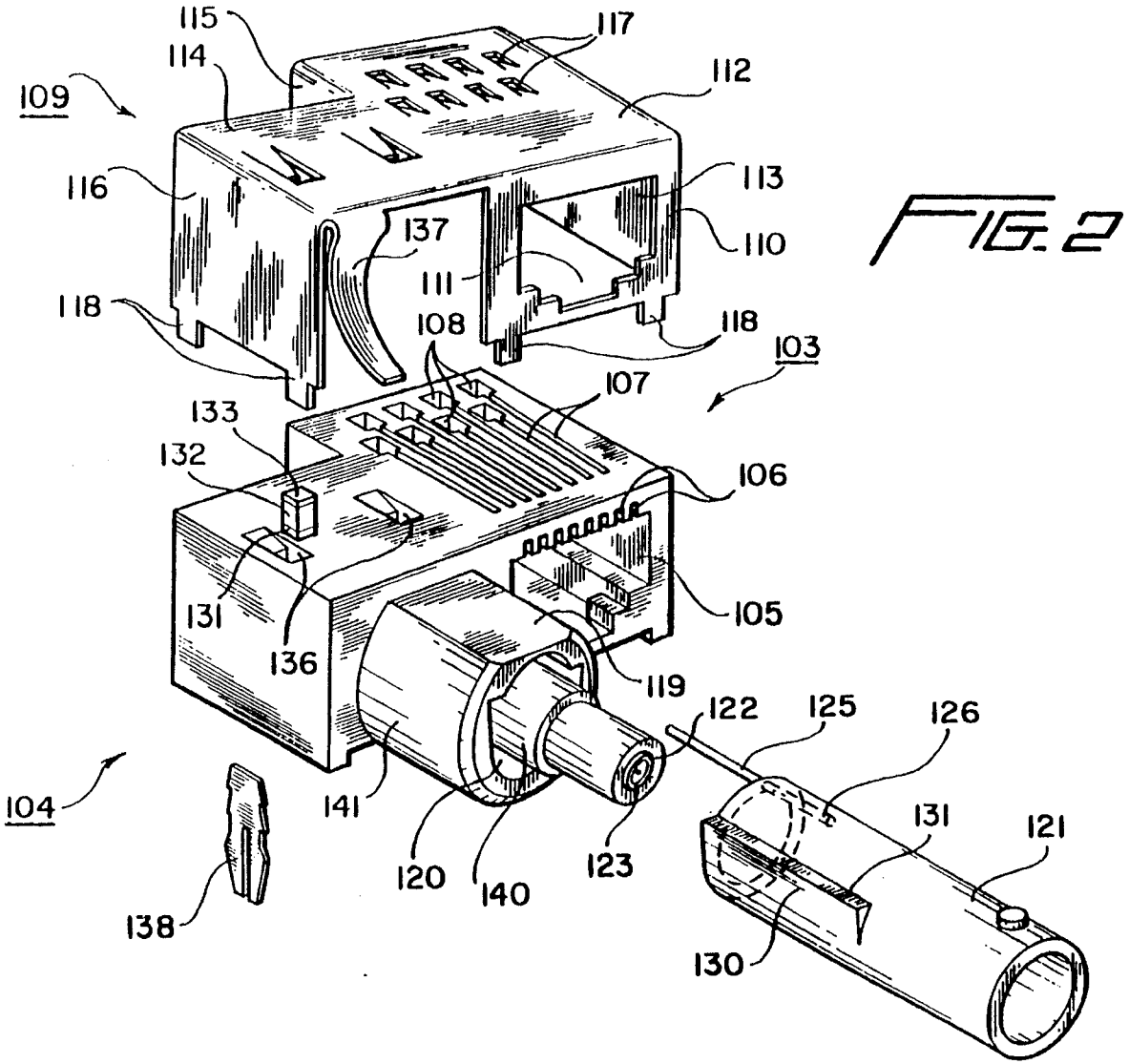
FIG. 2 is a perspective view of a connector constructed in accordance with the principles of a second preferred embodiment of the invention.
Figure 3:
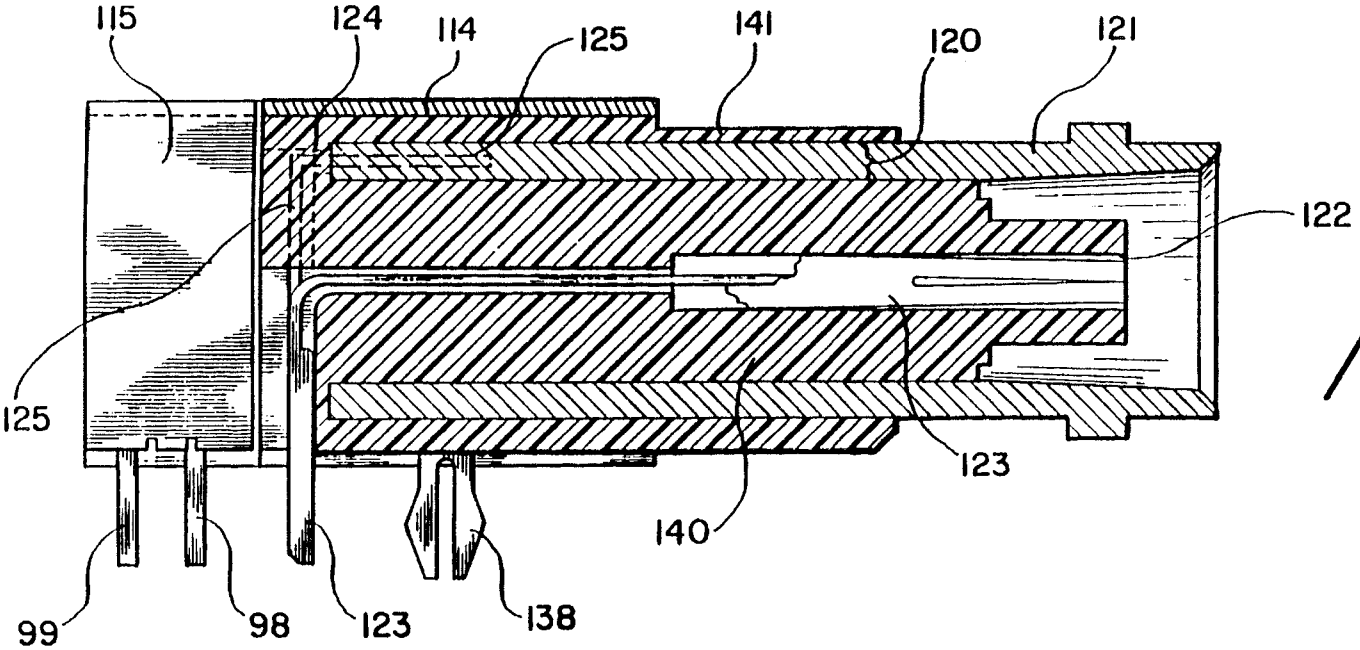
FIG. 3 is a cross-sectional side view of the connector shown in FIG. 2.
Figure 4:
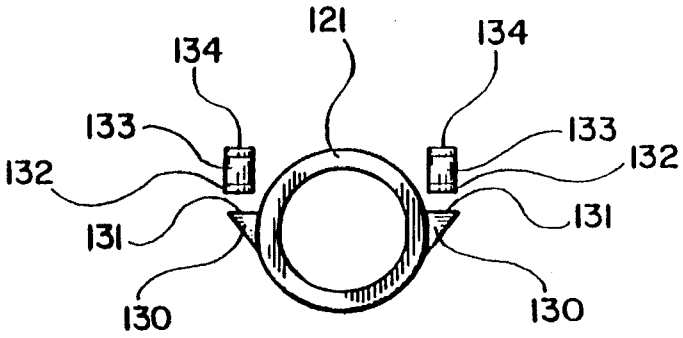
FIG. 4 is a front view of the outer contact for the BNC portion of the connector of FIG. 2.

Referring now to FIGS. 2–4, a combination connector according to a second preferred embodiment of the invention includes a modular jack section 103 having a shape identical to the shape of a standard modular jack connector, except that the housing is integrally molded with BNC connector section 104. Except as noted below, all components of both the modular jack section and the BNC section are standard, and thus only those features which represent improvements over conventional connectors of the subject types, or which are necessary for an understanding of the invention, are illustrated.

The body of the modular jack portion 103 of the combination connector illustrated in FIGS. 2 and 3 is identical to the modular jack disclosed in copending U.S. patent application Ser. No. 08/043,544, and includes a jack receiving aperture 105, openings 106 at the top of aperture 105, and grooves 107 in the top surface of the jack section for receiving contacts 98 and 99 having a generally standard configuration. Extending into the top surface of the jack section 103, towards the rear, are openings 108 into which may be placed filter elements (also not shown). As explained in the copending application, the contacts are positioned such that, when filter elements are place in the openings, electrodes on the filter elements engage the contacts.

As in the previous embodiment, the combination connector of this embodiment includes a single stamped and formed shield member 109 which includes a front wall 110 having a cutout or opening 111 corresponding in shape to the shape of the jack-receiving aperture 105, a top 112, a side wall 113, and an extension 114 of the top which covers the top surface of the BNC section 104 of the combination connector. Also part of the single shield member 109 are side walls 115 and 116 for respectively shielding remaining exposed sides of the modular jack and BNC sections of the connector. In addition, the shield member may include extensions (not shown) at the rear of the respective connector sections. As is apparent in FIG. 2, front wall 110, top portions 112, 114, and side walls 113, 115, and 116 are all mutually perpendicular.

The top of the shield member also includes, in the illustrated embodiment, downwardly extending tines 117 for engaging, in the manner disclosed in copending application Ser. No. 08/043,544, ground electrodes on any filter elements which have been inserted into openings 108. The shield member may be secured to the housing by tabs 118 which can be bent at a ninety degree angle to engage the bottom of the connector once the shield has been positioned on the housing, although those skilled in the art will appreciate that numerous alternative means may be sued to secure the shield on the connector.

The BNC section 104 of the combination connector includes two unique features which may also be used in stand-alone BNC connectors:

The first of these particularly unique and advantageous features is that all insulating portions of the BNC section, including the conventionally separate insulators 161 and 162, respectively, which surround the inner and outer coaxial contact, are molded in a single mold. Thus, the entire connector, including both the jack and BNC portions may be produced in a single step, without even the need for separate molding and assembly of the inner insulator.

This feature is accomplished, as is best shown in FIG. 3, by forming a single front insulating portion 119 of BNC section 103 with an annular groove 120 for accommodating the outer contact 121 and which separates insulators 140 and 141, and a cylindrical bore 122 in the portion of the insulator which lies within the groove 120 for accommodating the inner contact 123, and providing at the rear of the groove 120 which accommodates the outer contact 121 a through-hole 124. The outer contact 121 can thus be connected to the circuit board (not shown) on which the combination connector is mounted by providing an extension or a discrete contact pin 125 secured in bore 126 in the outer contact, and which is inserted through through-hole 124 as outer contact 121 is positioned from the front of the connector during assembly in the annular groove. After insertion, pin 125 is normally bent so that it extends downward past the rear of the BNC section to engage the circuit board, although those skilled in the art will appreciate that the principles of the invention will also apply to a vertical, as opposed to right angle, connector configuration (particularly in the case of a stand-alone BNC connector), in which case pin 125 would not be bent. As is conventional, the inner contact also includes an extension which is bent downward after insertion of the inner contact to engage an appropriate lead on the circuit board.

Filter capabilities are provided, according to a second unique and particularly advantageous feature of this embodiment, by an especially simple structure involving the inclusion of flanges 130 on the outer contact 121, as shown in FIGS. 2 and 4. Flanges 130 have an upwardly facing planar surface 131 for contacting the live electrode 132 of a chip capacitor or other filter element 133 placed into openings 136. The ground connection provided by the filter elements can then be completed simply by causing downwardly extending fines 134 cut out of the shield member 109 to engage a ground electrode 135 on the filter element, the tine biasing the filter element against the planar surface of outer contact 121 contact.

Also included as part of shield member 109 of this embodiment is a panel-engaging tongue 137 for directly grounding the shield member to a panel provided on the interface card, in the manner disclosed in copending application Ser. No. 08/075,876. Finally, while a separate board lock 138 is illustrated for this embodiment, it would of course also be possible to modify the shield casing to include a board lock in the manner similar to that of the first embodiment.

Those skilled in the art will appreciate that while filtering is required for some applications, the filter components may be omitted in others. Nevertheless, because the inclusion of component slots during the housing molding process requires no extra steps, and because mounting of the shield on the connector requires the same number of steps regardless of whether the filter components are included, the same housing and shield structure may be used for either the filtered or unfiltered situation, and the scope of the invention is intended to encompass both situations.

Figure 5:
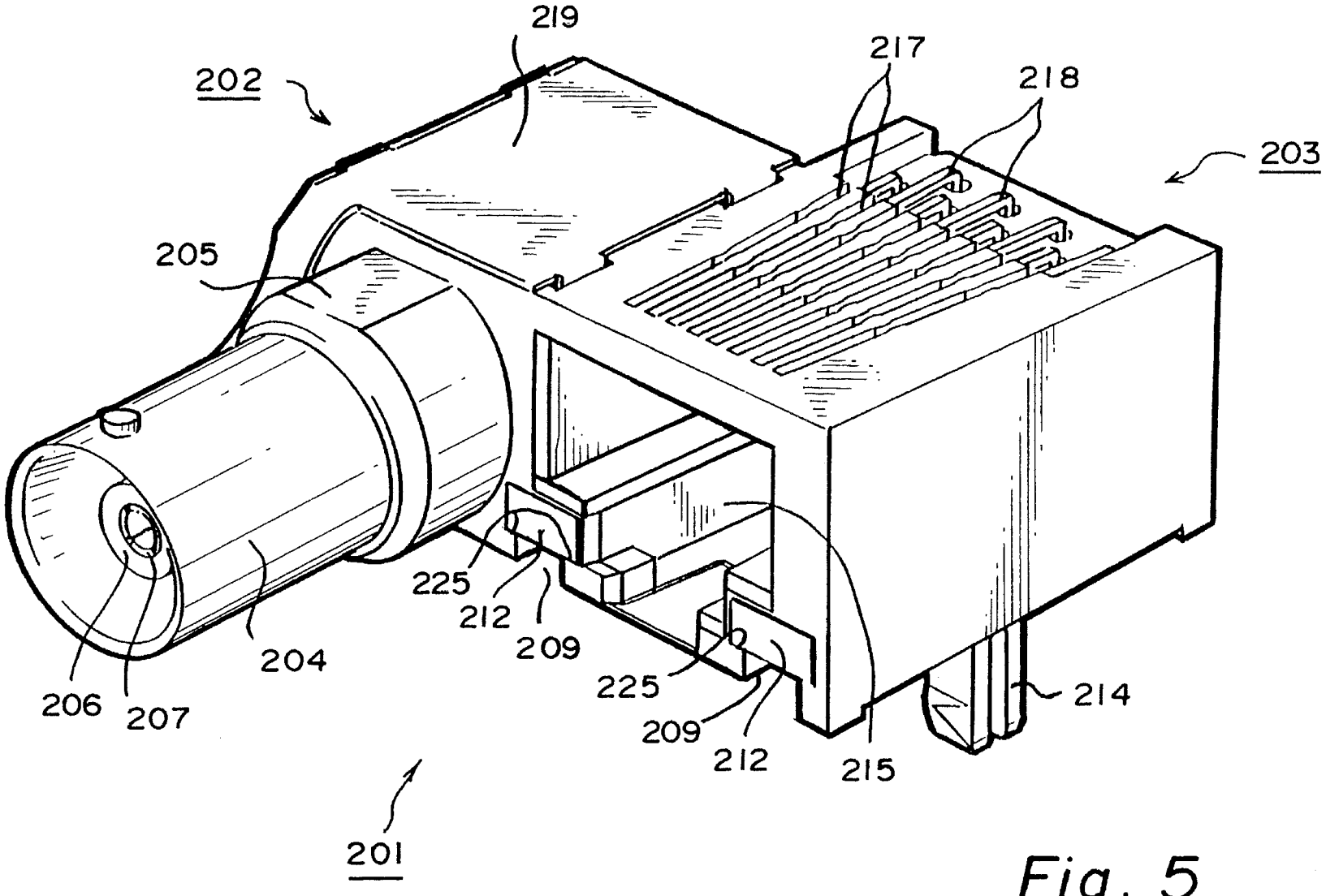
FIG. 5 is a perspective view a combination connector which includes an indicator light according to a third preferred embodiment of the invention.
Figure 6:
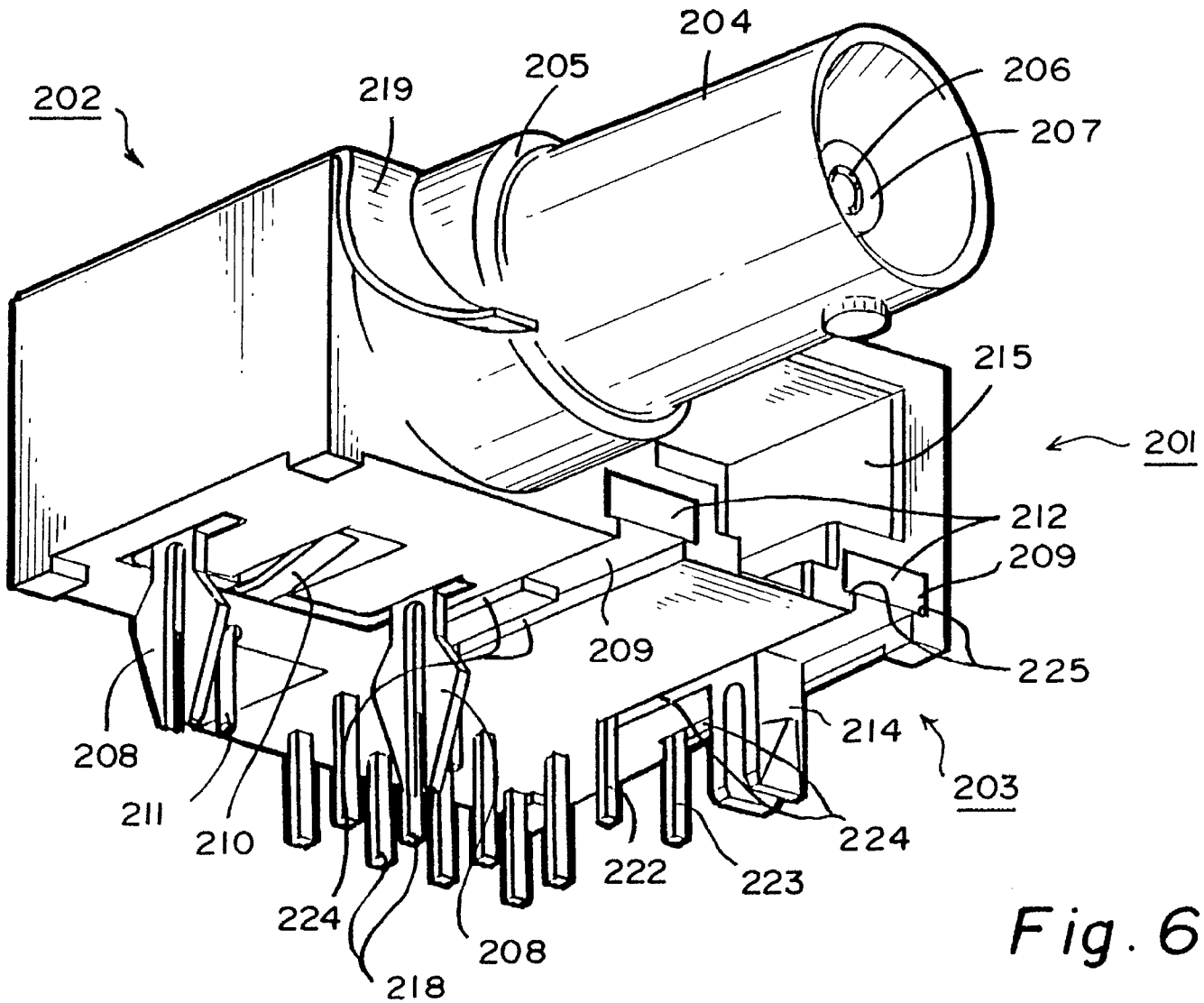
FIG. 6 is a second perspective view of the combination connector of FIG. 5.

Referring now to FIGS. 5 and 6, the connector of the third preferred embodiment of the invention includes single molded housing 201 made up of a BNC section 202 and a modular jack section 203. Except as noted below, all components of both the modular jack section and the BNC section are standard, and thus only those features which represent improvements over conventional connectors of the subject types, or which are necessary for an understanding of the invention, are illustrated.

The BNC section 202 of this embodiment may be identical to the BNC sections illustrated in any of FIGS. 1–4, including outer contact 204, outer insulator 205, inner contact 206, inner insulator 207, and board locks 208, although the particular configuration of the BNC connector can also be varied in ways not described above so long as the BNC section fits within a desired BNC connector profile. For example, as illustrated, the conductive path to the outer contact is provided by resilient contact finger 210 extending from contact 211.

The modular jack section 203 of the embodiment illustrated in FIGS. 3 and 4 can also be identical to corresponding modular jack sections of the embodiments illustrated in FIGS. 1–3, except for the presence of LED receiving openings 209, and can also be varied in ways not described above while still fitting within a modular jack profile. Included in the modular jack section of this embodiment are a boardlock 214, a jack receiving aperture 215, and grooves 217 in the top surface of the jack section for receiving contacts 218 having a generally standard configuration. Although the shielding 219 in this embodiment is illustrated as only covering the BNC section of the combination connector, it will be appreciated by those skilled in the art that the shield may be extended in the manner as illustrated above, including appropriate tabs for engaging filter components in either or both sections of the connector. It will be noted by those skilled in the art that if a combined shield is used, the shield would need to be modified to provide openings for the LED elements in the modular jack section.

The LEDs 212 are accommodated in this embodiment of the invention by providing the openings 209 within the stepped portion of the standard modular jack interior profile, into which are inserted LEDs 212 from which extend contacts 222 and 223. To accommodate contacts 222 and 223, openings 209 are continued by grooves 224 which extend rearwardly from openings 209, the contacts being bent at a ninety degree angle to exit the grooves and engage appropriately positioned terminals on the circuit board. This arrangement of the LEDs simplifies insertion and removal of the LEDs in comparison with the LED arrangement disclosed in U.S. Pat. No. 4,978,317, in which the LED contacts are molded into the top and rear of an RJ connector.

It will be appreciated, however, that the specific manner in which the LED contacts of the present invention are arranged may be varied by those skilled in the art, as may the location of the LED in the combination connector, and even the nature of the indicator, which may also be in the form of optical waveguides, incandescent lights, and other lighting arrangements sufficiently small to be mounted in the housing of a combination connector.

A particularly advantageous feature of this embodiment of the invention, which could be used in connectors other than a combination connector, is that the openings are exposed at the lower surface of the connector which mounted on the circuit board, the LEDs being held in place by shoulders 225 at the lower parts of the openings. Placement of the LEDs adjacent the lower surface of the connector has the advantage of minimizing the required contact length and exposure of the openings to the lower surface facilitates insertion and removal of the LEDs. Such insertion and removal is not possible in a molded-in arrangement of the type disclosed in U.S. Pat. No. 4,978,317.

It should be apparent from the above description that the connectors of the preferred embodiments contain an absolute minimum of parts. A list of parts which must be assembled for the two embodiments is as follows:

1. a plastic housing for both the RJ 45 jack and the BNC connector, which may include both the inner and outer BNC insulators (those skilled in the art will appreciate that the one piece insulator design used in the second embodiment may also be adapted for the first embodiment), 2. a shield casing common to both connectors which also facilitates filtering, and 3. optionally, an LED and contacts therefor.

The only remaining elements necessary to complete functional connectors are the modular jack and BNC contacts. To add filtering, the assembler merely needs to insert capacitor chip or other appropriately sized filter chips into openings provided in the modular jack and BNC sections of the respective preferred connectors. No extra parts are required.

In order to assemble the preferred connectors, the modular jack, BNC, and, if applicable, multiple pin parallel-type connector contacts need to be inserted into the respective connector sections, followed by insertion of any desired filter chips, and placement of the combined shield casing over the plastic insulative one-piece molded housing. Thus just two basic assembly steps (three if filtering is desired, are necessary to complete assembly of a fully functional combination connector.

Because the modular jack shield and BNC ground connection are stamped from a single sheet of conductive metal, and because of the shared walls, less metal is required and at the same time a single assembly step suffices to provide both the necessary shielding for both the modular jack and the grounding for the BNC connector. Those skilled in the art will, however, appreciate that numerous variations in the concept of a common shield can be provided, including designs which merely provide a shielding function rather than a filtering function, and designs for various types of connectors other than the three types of connectors shown. As a result of such possible modifications, and others which will undoubtedly occur to those skilled in the art, it is intended that the invention not be limited by the above description or the attached illustration, but rather that it should be limited solely in accordance with the appended claims.

We claim:

1. A combination connector, comprising a BNC connector and modular jack connector, wherein the BNC connector and the modular jack connector share a single molded housing, each connector having a respective housing section, the housing sections being molded together as one piece to form the single molded housing, and wherein the single molded housing includes an opening into which is fitted an indicator light.

2. A combination connector as claimed in claim 1, wherein the indicator light is an LED.

3. A combination connector as claimed in claim 1, further comprising a second opening in said single molded housing into which is fitted a second indicator light.

4. A combination connector as claimed in claim 3, wherein said combination connector includes a front face into which extends an aperture for receiving a mating connector and a lower surface adapted to be seated on a printed circuit board, and wherein said openings are situated adjacent the lower Surface and extend rearwardly from the front surface of the connector.

5. A combination connector as claimed in claim 4, wherein said openings are exposed at said lower surface to facilitate insertion and removal of the indicator lights from the connector.

6. A combination connector as claimed in claim 4, further comprising grooves in said lower surface which extend rearwardly from said openings to accommodate contacts extending from said indicator lights, said contacts being bent to exit said grooves and engage terminals on the circuit board.

7. A combination connector as claimed in claim 1, wherein said combination connector includes a front face into which extends an aperture for receiving a mating connector and a lower surface adapted to be seated on a printed circuit board, and wherein said opening is situated adjacent the lower surface and extends rearwardly from the front surface of the connector.

8. A combination connector as claimed in claim 7, wherein said opening is exposed at said lower surface to facilitate insertion and removal of the indicator light from the connector.

9. A combination connector as claimed in claim 7, further comprising grooves in said lower surface which extend rearwardly from said openings to accommodate contacts extending from said indicator light, said contacts being bent to exit said grooves and engage terminals on the circuit board.

10. In an electrical connector, comprising:

a molded housing having an opening into which is fitted an indicator light, the molded housing including a front face into which extends an aperture for receiving a mating connector and a lower surface adapted to be seated on a printed circuit board, the improvement wherein said opening is situated adjacent the lower surface and extends rearwardly from the front surface of the connector to form a means for receiving said indicator light only in a direction parallel to the lower surface of the connector, said opening including means for retaining said indicator light in the connector upon insertion, and wherein said indicator light is exposed at said lower surface to permit the indicator light to be engaged from below during insertion and removal and thereby facilitate insertion and removal of the indicator light from the connector without allowing removal of said indicator light from below in a direction normal to the lower surface of the connector.

11. A connector as claimed in claim 10, further comprising grooves in said lower surface which extend rearwardly from said opening to accommodate contacts extending from said indicator light, said contacts being bent to exit said grooves and engage terminals on the circuit board.

12. A connector as claimed in claim 10, wherein said indicator light is an LED.

* * * * *

UNITED STATES PATENT AND TRADEMARK OFFICE

CERTIFICATE OF CORRECTION

PATENT NO. : 5,601,451

DATED : February 11, 1997

INVENTOR(S) : Francisco R. BRIONES et al.

It is certified that error appears in the above-indentified patent and that said Letters Patent is hereby corrected as shown below:

On the title page, under item [19] and item [75], change "Driones" to --Briones--.

Signed and Sealed this

Fifteenth Day of April, 1997

Bruce Lehman

*Attest:*

BRUCE LEHMAN

*Attesting Officer*

*Commissioner of Patents and Trademarks*